United States Patent [19]

Callihan et al.

[11] 4,088,186

[45] May 9, 1978

[54] CENTERING DEVICE FOR WELL CONDUIT

[75] Inventors: Rudy B. Callihan; Thomas E. Bagley; Alvin K. Warzecha, all of San Antonio; David J. Vlasek, Converse, all of Tex.

[73] Assignee: Baker International Corporation, Orange, Calif.

[21] Appl. No.: 753,178

[22] Filed: Dec. 22, 1976

[51] Int. Cl.[2] ..... E21B 17/10

[52] U.S. Cl. ..... 166/241; 166/173

[58] Field of Search ..... 166/241, 315, 170, 172, 166/173, 174, 175, 176; 308/4 A

[56] References Cited

U.S. PATENT DOCUMENTS

| | | | |
|---|---|---|---|
| 1,404,874 | 1/1922 | McKissick | 166/241 X |
| 2,845,128 | 7/1958 | Clark, Jr. et al. | 166/173 |
| 2,849,071 | 8/1958 | Park | 166/241 |
| 3,055,432 | 9/1962 | Park | 166/241 |

*Primary Examiner*—Ernest R. Purser
*Assistant Examiner*—Richard E. Favreau
*Attorney, Agent, or Firm*—William C. Norvell, Jr.

[57] ABSTRACT

A centering device is provided which is adapted to be mounted on a running-in string for subsequent disposal in a well bore. Upper and lower companion supporting members having a plurality of circumferentially spaced openings therein and shoulders circumferentially extending around the uppermost interior of each of the supporting members are provided for receipt of circumferentially spaced and outwardly bowed springs having upper and lower ends overlying the lower portion of the exterior of the supporting members and extending inwardly through the openings. The springs have portions disposed in the openings with the upper and lower ends of the springs respectively engaging the upper and lower shoulder of the support members. The spring portions include extensions received in the openings whereby each of the spring extensions longitudinally overlaps that portion of the supporting member defining the opening to interlock the spring extension with the portion of the supporting member to prevent removal of the spring from the support upon permanent securement of the spring to the supporting member. The opening receives the spring witout permitting lateral shifting of the spring within the supporting member.

8 Claims, 7 Drawing Figures

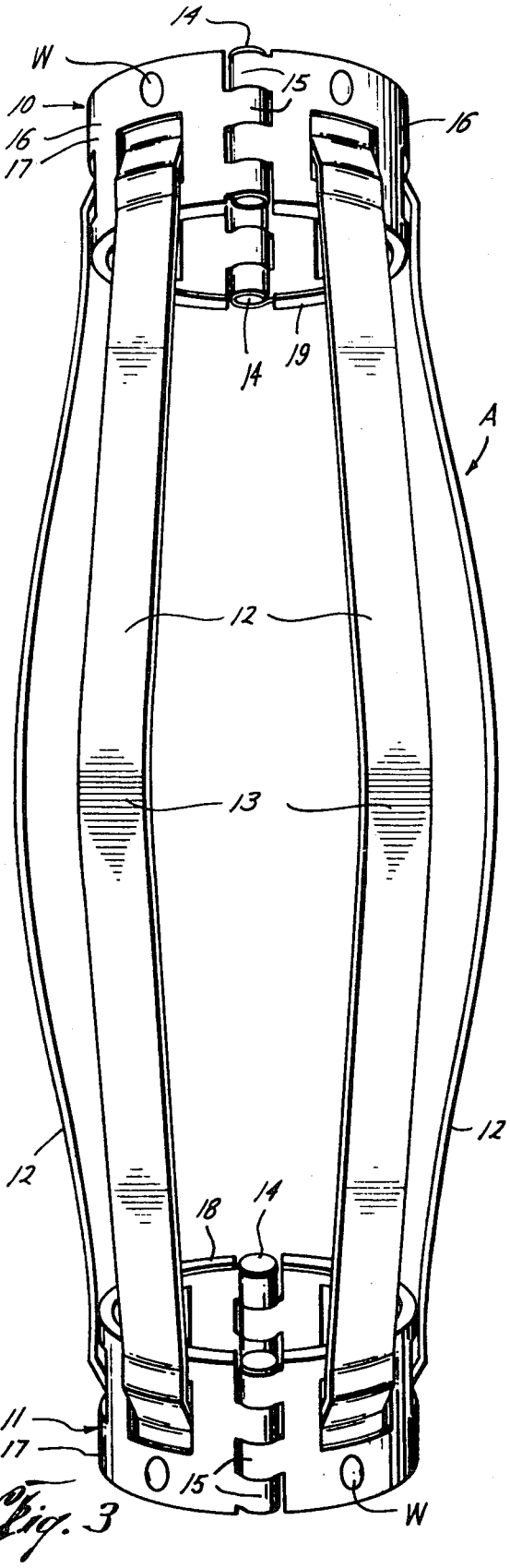
Fig. 3
Fig. 1
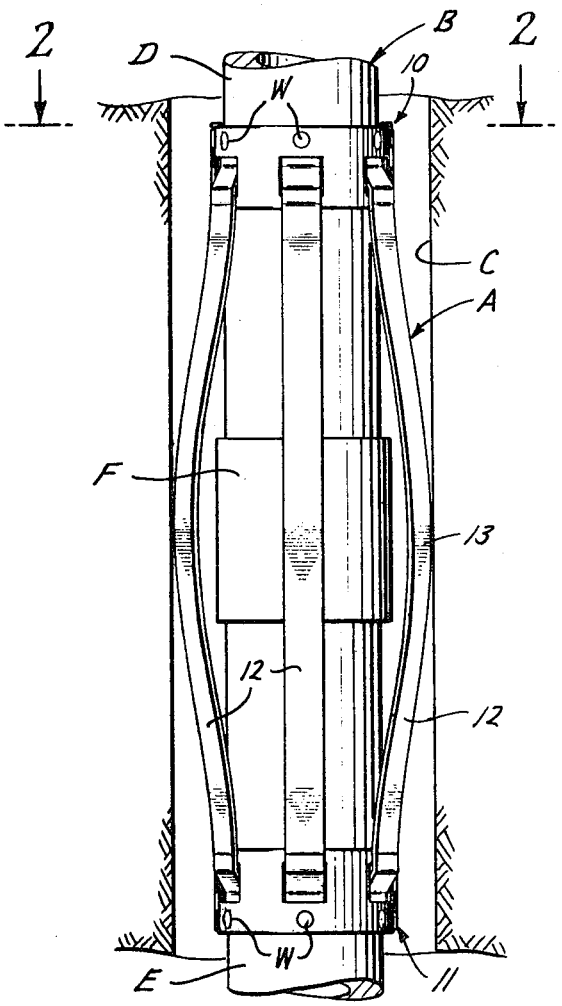
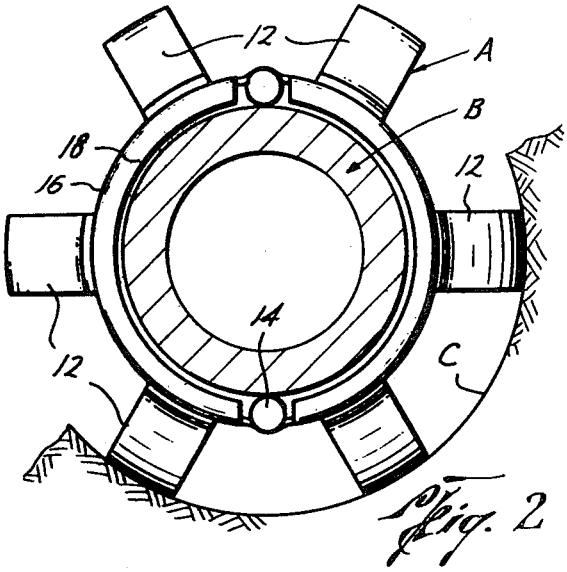
Fig. 2

CENTERING DEVICE FOR WELL CONDUIT

BACKGROUND OF THE INVENTION

1. Field of the Invention

The present invention relates to centering devices, and more particularly to devices adapted to be mounted on well casings, liners, tubings, and similar conduit strings, for the purpose of centering such strings in well bores.

2. Description of the Prior Art

Centering devices having outwardly bowed springs are mounted on casing strings, or similar conduit strings, disposed in well bores for the purpose of placing and maintaining the casing strings substantially coaxially in the well bores. In some instances, the parts of said centering devices have been permanently assembled to one another at the point of manufacture, requiring the shipment in an assembled condition. In view of the large space or volume occupied by an assembled centering device or centralizer, substantial labor and material costs are entailed in boxing or crating it for shipment. Moreover, shipping costs have been comparatively high because of the large bulk or volume presented by the completed centering device, whether shipped boxed or unboxed. The large volume of the centering device also requires correspondingly large storage or warehouse space, which is costly to provide.

Conduit string centering devices have included end collars or annular members to which outwardly bowed springs have been welded. The welding operation entails the majority of time utilized in construction of the centering device. In prior art devices which have welding operations as a step in the manufacturing procedure, the completed apparatus oftentimes has resulted in a product which will enable the spring to give way during the transmission of the centering device within the well bore on the tubing or other strings because of the exteriorally affixed spring in relation to the collar element. That is, the spring has been welded to the exterior of the collar. Because the spring is outwardly flexed, and stress is exerted on the spring at the so-called "stress point", a break in the weld and/or the spring itself at the stress point will necessarily entail a break in the spring and/or a separation of the collar and spring, resulting in the spring being normally urged outwardly and away from the collar to the bore of the well, thus interrupting comparatively free travel of the centralizer mechanism in the well for setting. Additionally, breakage of the weld will prevent effective centering operation of the centering device.

Although non-welded centering devices have been offered by the prior art which have some advantages, particularly in view of the comparatively small amount of time and component parts utilized to assemble the devices, welded centering devices generally afford the most durable apparatus. However, because of the additonal manufacturing step of welding, heretofore welded centering devices have not been entirely successful.

Accordingly, it is an object of the present invention to provide an improved centering device or centralizer for well conduits that can be shipped to the point of use in a disassembled and compact condition, and then readily assembled at such point of use or at any other desired place, thereby effecting substantial savings in labor, material and time necessary for boxing, and in transportation costs, as well as in storage costs.

Another object of the invention is to provide a centering device or centralizer for well conduit strings that requires no particularly special equipment for its assembly. In fact, the parts of the present centralizer can be assembled by one or more relatively unskilled personnel utilizing a minimum of equipment and machinery.

A further object of the invention is to provide a centering device or centralizer for a well conduit embodying outwardly bowed springs adapted to be attached to associated collars or annular members by spot welding or otherwise permanently securing the parts to one another.

Yet another object of the invention is to provide a centering device for a well conduit in which the centering spring members can be assembled to the collars during a comparatively easy manufacturing procedure, and in which the springs remain properly assembled to the collars during normal handling of the device, during its installation on the well conduit, and during its running in the well bore. In addition, the construction of the well conduit centering device is such that in the event of a break in the weld of the spring to the supporting member, the spring is held in position and will not "pop out" of the supporting member. Therefore, the spring always will be in position to afford centering of the well conduit.

An additional object of the invention is to provide a centering device for a well conduit, the springs of the device being assembled readily by easy manufacturing applications in self-locking relation to the collars of the device, whereby disassembly of the device cannot be accomplished inadvertently.

It is a further object of the present invention to afford a method of assuring easy construction of the springs to the supporting members by providing support members which can be affixed to an inwardly and circumferentially extending shoulder upon each supporting member for resting of the respective ends of the spring members to assure further permanent securement of the spring to the support members.

It is a further object of the present invention to provide a well conduit centering device which provides a spring member welded or otherwise permanently secured to upper and lower supporting members, the weld or other permanent securing means of the spring to the support members being away from the stress point of the spring to provide additional strength in the spring and avoid weakness thereof by improper welding or other permanent securement.

It is a further object of the present invention to provide a well conduit centering device which will, upon failure of the weld or welds or other permanent securement, entrap the spring within the support member.

It is a further object of the present invention to provide a well conduit centering device having a flexing spring element, the flexing force of the spring not being carriable by the weld or other permanent securing means of the spring to the respective supporting members.

It is a further object of the present invention to provide a centering device for a well conduit embodying springs attached to collars, in which inward force or load on the spring tends to retain the attachment and assembled relation of the springs to the collars.

It is a further object of the present invention to provide a centering device for a well conduit embodying springs capable of ready assembly to associated collars, the assembled device being economical to produce, and being of strong and sturdy construction.

Other objects of the present invention will be apparent from a reading of the Figs., the specification below, and the claims.

BRIEF DESCRIPTION OF THE DRAWINGS

FIG. 1 is a side elevational view of a centering device mounted on a conduit string and disposed in a well bore.

FIG. 2 is a cross-sectional view of the device of FIG. 1 taken along lines 2—2 of FIG. 1.

FIG. 3 is a side elevational view of the centering device of the present invention showing both half sections of the apparatus in its fully constructed form.

DESCRIPTION OF THE PREFERRED EMBODIMENTS

Figures 4, 5, 6, 7:
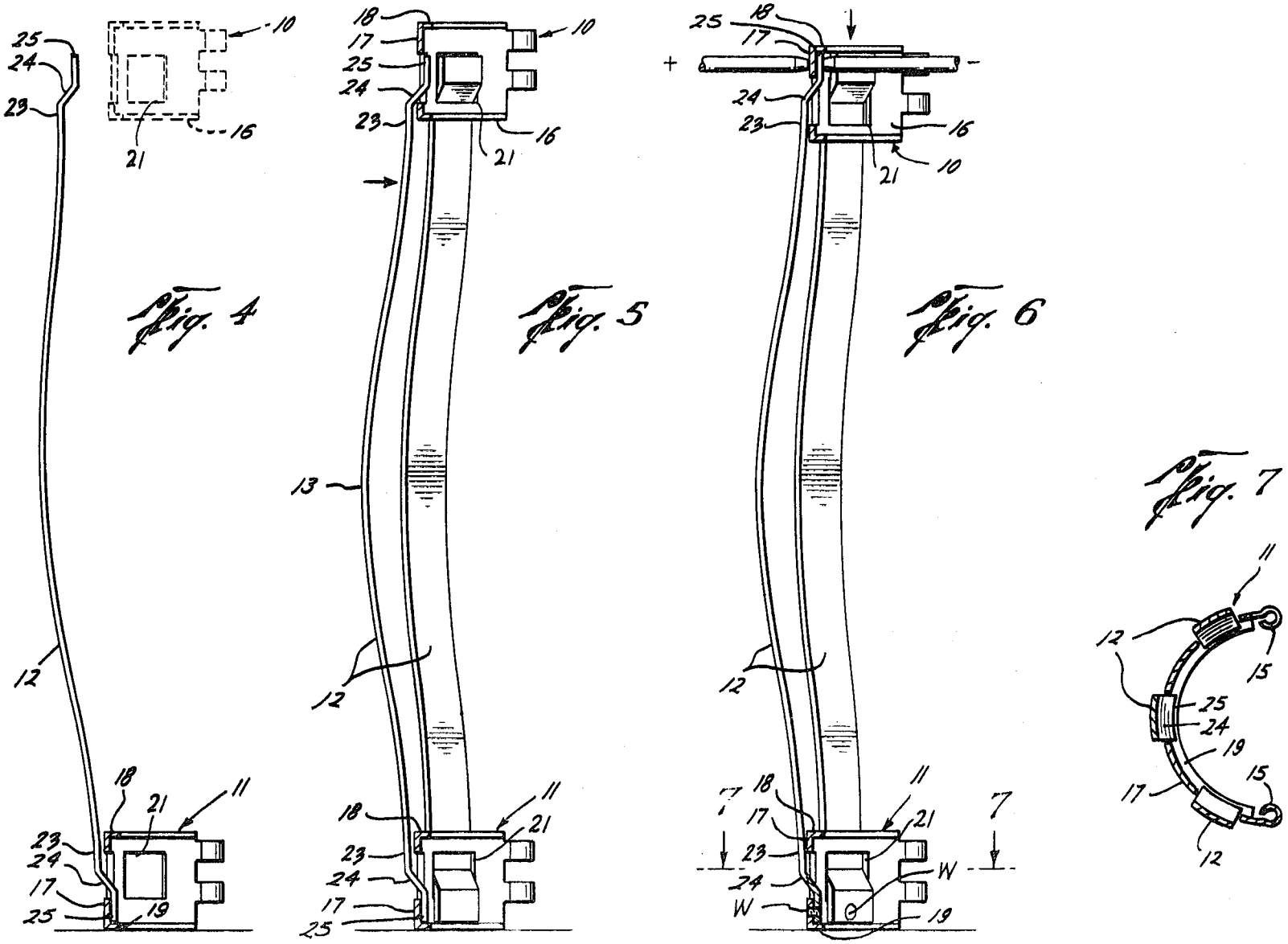
FIG. 4 is a view illustrating the initial assembly of the spring and supporting elements.
FIG. 5 is a side frontal view similar to that of FIG. 4 showing assembly of the support member to two spring elements during construction.
FIG. 6 is a side elevational view similar to that shown in FIGS. 4 and 5, showing particularly the welding step of the manufacturing of the apparatus.
FIG. 7 is a partial sectional view of the apparatus of FIG. 6 taken along line 7—7 of FIG. 6.

As illustrated in FIG. 1, a centering device A is mounted on a conduit string B, such as a string of well casing, that is run in a well bore C, and which is to be mounted in substantially a centered condition therewithin. The casing string includes an upper casing section D and a lower casing section E suitably secured to one another by a coupling collar F.

The centering device A includes upper and lower collar member 10 and 11 slidably mounted on the casing string B and intervening outwardly bowed springs 12 secured to the collars with their mid-portions 13 adapted to bear against the wall of the well bore C to hold the casing string centered or substantially centered therewithin. The upper and lower collars 10 and 11 are disposed on opposite sides of the coupling collar F, the latter funcitioning as a stop ring, being adapted to engage a lower collar 11 and pull the centering device downwardly in the wall casing, the coupling member F also being adapted to engage the upper collar 10 in pulling the centering device upwardly in the well casing upon upward movement of the casing string B therewithin. As is known in the art, in lieu of the mounting of the centering device A on opposite sides of the coupling member F the entire device could be mounted on a single section of casing B with a coupler F suitably secured to said section between the upper and lower collars 10 and 11 of the centering device of the present invention.

The centering device A consists of two main half sections that can be placed laterally around the conduit string B and then secured to one another. Each of the half sections are shown in FIG. 3, the half sections being separated by a hinge and pin combination, described below. The parts of each half section can be assembled to one another during an easy manufacturing process utilizing primarily hand labor and simple, readily available tools, including arc welding equipment. The respective half sections then are secured to one another, to complete the centralizer, upon placing of the half sections around the conduit string and then inserting hinge pins 14 through the interleaved hinged knuckles 15 on diametrically opposite sides of each of the collars 10 and 11.

The upper and lower collars or annular members 10 and 11 are duplicates of one another and are oppositely arranged. Thus, the upper collar 10 includes two half sections or segments 16 attached to one another by the diametrically opposite hinge pins 14, the half sections being the same. As shown particularly in FIG. 5, each section includes an outer sleeve section 17 having upper and lower inwardly directed flanges 18 and 19 integrally associated therewith. Such a sleeve section may be formed readily from sheet metal. The ends of each outer sleeve section terminate in the hinge knuckles 15, the hinge knuckles at one end being in staggered relation to the hinge knuckles at the other end, such that when the two outer sleeve sections 16 are placed against one another, the hinge knuckles 15 on one sleeve section will interleave with the hinge knuckles on the other section, whereby the sections 16 are in transverse alignment with one another, being held in assembled relation upon insertion of the hinge pins 14 through the interleaved hinge knuckles.

The upper and inwardly directed flange 18 serves the office of a shoulder element circumferentially extending inwardly and around the support members 10 and 11. Upon each of the respective flanges 18, securely rests the respective ends 25 of the spring elements 12 such that, even though the spring 12 is not yet welded to the respective support member, such as 10, the spring is prevented from shifting laterally out of the element 10. The shoulder 18, in combination with the spaced opening 21, described below, provides a snug fit of the spring 12 within the support member, such as 10.

The collar section 16 has circumferentially spaced openings 21 through which the ends 25 of the springs 12 can be inserted from the exterior of each collar section to its interior. Each of the openings 21 is preferably of window-like configuration and fit the spring element 12 snugly to avoid a lateral functional movement with relation to the support members 10 or 11, as the case may be. But, each of the openings 21 is designed such that the width of the portion of the spring 12 extending therethrough is accepted by its companion support member, to facilitate assembly of the springs 12 to the collar section or segment 16, as described hereinbelow.

An upper portion 23 of each spring 12 may be substantially parallel to the axis of the collar 10, serving as a heel or fulcrum bearing against the exterior of the outer sleeve member 17 below the opening 21. This heel or fulcrum 23 merges into an inclined spring portion 24 extending inwardly through the openings 21, such intersection portion merging into a terminal portion or end 25 which, when assembled to the collar section, is adapted to be substantially parallel to the axis of the collar and abuts the shoulder 18 on the support member 10 or 11. This terminal portion 25 is preferably curved, conforming to the curvature of the collar 10 so as not to project substantially inwardly of such sleeve.

The inclined spring portion 24 also defines the approximately "stress point" or "point of stress" along the outwardly bowed spring element 12 immediate to each of the sleeves 10 and 11, that is, the maximum load point on the spring when the spring is caused to flex inwardly upon insertion in the well bore and upon contact with the bore wall of the well.

It is to be noted that when the springs 12 are assembled through the openings 21 in the collars, and with their heads or ends 25 abuting the shoulder 18, such heads 25 are prevented from moving outwardly since they will engage the sleeve section 17 of the collar. Once the selected plurality springs 12 are assembled within the support members and within the shoulder 18 on each collar section, in both the upper and lower collars 10 and 11, one half of the centralizer has been assembled, as is shown in FIG. 5. The springs 12 cannot be removed inadvertently from assembled relation to the collars 10 and 11 without intentionally doing so. At this point during the manufacturing procedure, spot welding, as shown in FIG. 6 may be initiated to spot weld each of the spring elements 12 to its support members 10 and 11 and thus form spot weld W by applying a cathodic element to one side of the surface to be welded and an anodic element to the other of said surfaces and transmitting therethrough an electric current at a predetermined voltage and rate. Alternatively, each of said springs may be assembled circumferentially and selectively around the collar elements and thereafter the welding procedure as described above and shown in FIG. 6 may be initiated. The particular mode of welding the spring elements to the support members 10 and 11 is not critical to adaptation of the present invention, it being essential only to secure the spring element 12 within the support members 10 and 11 in manner such that the shoulder 10 in conjunction with the snug fit through the portals 21 securely engage the spring element within the support members 10 and 11. Thus, it can be seen that screws, bolts or other permanent securement elements may be utilized to secure the springs to the collars in place of welding.

The lower portion of the centering device is the same as the upper portion, except the parts are oppositely directed. The springs 12 fit through the openings 21 in the half section 16 of the lower collar 11.

Two completed half sections of the centering device are then placed laterally around the conduit string B, with the upper and lower collars 10 and 11 on opposite sides of the stop ring F. Hinge pins 14 are then inserted through the interleaved hinge knuckles 15 at diametrically opposite points of each collar, to complete the assembly and to retain the half sections connected to one another. These hinge pins 14 may, if desired, make a forced fit with the hinge knuckles 15, so as to remain secured thereto and to avoid inadvertent removal therefrom.

In the use of the centering or centralizer device A as illustrated above, it is mounted on the well casing B, as described, and the latter is then run in the well bore. During downward movement, the stop ring F engages the lower collar 11, the springs 12 being pulled downwardly through the well bore C, and past any obstructions or restrictions that might be encountered therewith. As described above, the terminal or end portions 25 of the spring elements 12 cannot shift from position within the interior of the respective support members 10 and 11 and upon placement upon circumferentially and inwardly extending shoulder 18 since any inward force on the intermediate portions of the spring 12 results in a tendency for the terminal portion 25 to shift outwardly against the outer sleeve sections 17, due to the fulcruming of the heel portions 23 on the exterior of the collar. The terminal or end portions 25 cannot shift inwardly of the collar or latitudinally therein in view of the welding of the spring element 12 immediate the terminal end portion 25 to the collar element, such as 10. Additionally, the end portions 25 are prohibited from latitudinal shifting within their respective openings 21 because of the sizing of the openings 21 in relation to the spring elements 12. Although not essential in the operation of the present invention, upon mounting of the centering device on the conduit string B, the perifery of the latter makes a fairly close fit with each collar 10 and 11, as well as with the terminal or end portions 25 of the spring elements 12, the latter being prevented by the conduit string itself from moving inwardly and out of the slots 21.

Thus, from the above, it can be seen that the centering device of the present invention affords an easily constructable apparatus whose respective parts are affixed one to another by hand operation in conjunction with procedures such as spot welding and the like. In addition, when a welding procedure is applied to affix the respective springs to the respective collar elements, the weld is applied in such a fashion that the weld spot or the securing point of the spring to the collar is away from the stress point of the spring, further assuring a secure assembly. In this regard, it can be seen from the above that the present apparatus has the tensile and/or load strength of a non-welded centralizer. Furthermore, in the event of a faulty or defective weld or other failure in the weld securement of the spring to the collar, the spring element is trapped within each of the respective collars, such that the spring ends will not fly out of and away from the respective collars and render the apparatus inoperable in the well bore. Furthermore, because the weld of the spring to the collar is away from the stress point, the force created by the flexing of the spring element is not carried immediately by the weld.

Despite the fact that the springs 12 cannot be readily disassembled from the collars 10 and 11, the assembly of the springs to the collars can occur in a comparatively easy manner by use of unsophisticated tooling and comparatively inexperienced personnel.

The mode of assembly is shown in FIGS. 4 thru 6, inclusive. In FIG. 4, the lower ends of the springs have been inserted within and through a lower collar section 16. This can occur easily because the upper ends of the springs are free at this time, and the springs can be moved readily to insure the assembly of the lower terminals or ends of the springs in their companion openings. An upper collar section 16 is then slipped over the upper ends of the springs 12 such as shown in FIG. 5. To enable the flipping of the upper ends of the springs 12 within the upper collar section 16 opening 21, the latter has a slightly greater width than the width of the spring, but this width is not sufficient enough to enable comparative lateral shifting of the spring elements within the opening 21, but only enables relative longitudinal movement of the spring element 12 for affixation within the upper end of the collar section 16 upon the shoulder 18.

Moving to FIG. 6, the spring elements 12 may be separately spot welded in position with the upper end 25 affixed to the shoulder 18 of each of the respective members 10 and 11. Alternatively, each of the spring elements 12 may be circumferentially inserted within their respective openings 21 within the collar elements 10 and 11, and thereafter spot welding of the upper portion 25 may be accomplished.

As described above, the spring element 12 will remain in the assembly in position with respect to the upper and lower collar sections because of the shouldering of the terminal or end portions 25 upon the circumferentially extending and inwardly protruding shoulder 18 in combination with the flex of the spring element 12 together with the size of the opening 21, which prevents latitudinal shifting of the spring element 12 within the members 10 and 11 respectively. The one half of the centering device can be moved around or handled normally, without the fear of disassembly of the springs from the collar section, before spot welding thereof. When the full centralizer is completed, the two halfs are placed laterally toward each other over the casing B, and on opposite sides of the stop ring F and the hinge pins 14 are inserted in place, as above described.

If desired, the parts need only be assembled when the centering device is to be mounted on the conduit string B and this can take place near the well site if desired, with proper safety precautions being taken for the application of the welding technique as described above. The springs 12 are readily mounted in the upper and lower collar sections 16 by hand, and as in the manner as described above, with the two centering device sections being placed on the conduit string B at the desired location and the lock pins 14 thereafter inserted in their proper places.

It is not critical to the present invention that the spot welding technique as described above and exemplified in FIG. 6, be utilized. Alternatively, the end members 10 and 11 may be affixed to the respective spring elements 12 by other means, such as by inserting a pin, bolt, screw, or other solid means insertable through the spring and the collar. However, spot welding of the spring 12 to the upper and lower collar members 10 and 11 is simple, not time consuming, and is applicable through use of relatively unskilled labor and affords a better securement of the spring 12 to the upper and lower collar members 10 and 11. For this reason, it is the preferred method of securing the springs 12 to each of the collar members 10 and 11.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is desired to be secured by Letters Patent is:

1. A centering device adapted to be mounted on a running-in string to be disposed in a well bore, comprising: upper and lower companion supporting members having a plurality of circumferentially spaced openings therein, shoulder members on each of said upper and lower companion supporting members circumferentially extending around the uppermost interior of said supporting members, circumferentially spaced outwardly bowed springs having a point of stress and upper and lower ends overlying the exterior of said supporting members and extending inwardly through said openings, said springs having portions disposed in said openings, said springs having immediate each end thereof a fulcrum, an inwardly extendible incline defined immediate said fulcrum, each of said spring ends conforming to the curvature of the respective supporting member and adapted to be substantially parallel to the axis of said respective supporting member, said incline defining the point of stress of said bowed springs, the upper and lower ends of said springs respectively engaging the circumferentially extending shoulders of said support members, said portions of said springs including extensions received within said openings whereby each of said spring extensions longitudinally overlaps that portion of said supporting member defining, in part, said opening to interlock said spring extension with said portion of said supporting member to prevent removal of said spring portion from said support, said opening receiving said spring without permitting lateral shifting movement of said springs, said spring ends being welded to said supporting members, the engagement of said spring ends upon said shoulders providing means for applying the weld of the spring ends and the shoulders away from the point of stress and toward said shoulders.

2. A centering device adapted to be mounted on a running-in string to be disposed in the well bore, comprising: upper and lower companion members having a plurality of circumferentially spaced openings therein, shoulder members on each of said upper and lower companion supporting members circumferentially extending around the uppermost interior of said supporting members, circumferentially spaced outwardly bowed springs having a point of stress and upper and lower ends overlying the exterior of said supporting members and extending inwardly through said openings, said springs having portions disposed in said openings, said springs having immediate each end thereof a fulcrum, an inwardly extendible incline defined immediate said fulcrum, each of said spring ends conforming to the curvature of the respective supporting member and adapted to be substantially parallel to the axis of said respective supporting member, said incline defining the point of stress of said bowed springs, the upper and lower ends of said springs respectively engaging the circumferentially extending shoulders of said support members, said portions of said springs including extensions received within said openings whereby each of said spring extensions longitudinally overlaps that portion of said supporting member defining, in part, said opening to interlock said spring extension with said portion of said supporting member to prevent removal of said spring portion from said support, said opening receiving said spring without permitting a lateral shifting movement of said spring, said spring ends being permanently affixed to said supporting members, the engagement of said spring ends upon said shoulders providing means for applying the permanent affixation of the spring ends and the shoulders away from the point of stress and toward said shoulders.

3. A centering device adapted to be mounted on a running-in string to be disposed in a well bore, comprising: upper and lower companion members having a plurality of circumferentially spaced openings therein, shoulder members on each of said upper and lower companion supporting members circumferentially extending around the uppermost interior of said supporting members, circumferentially spaced outwardly bowed springs having a point of stress and upper and lower ends overlying the exterior of said supporting members and extending inwardly through said openings, said springs having portions disposed in said openings, said springs having immediate each end thereof a fulcrum, an inwardly extendible incline defined immediate said fulcrum, each of said spring ends conforming to the curvature of the respective supporting member and adapted to be substantially parallel to the axis of said respective supporting member, said incline defining the point of stress of said bowed springs, the upper and lower ends of said springs respectively engaging the circumferentially extending shoulders of said support members, said portions of said springs including extensions received within said openings whereby each of said spring extensions longitudinally overlaps that portion of said supporting member defining, in part, said opening to interlock said spring extension with said portion of said supporting member to prevent removal of said spring portion from said support, said opening receiving said spring without permitting a lateral shifting movement of said spring, said spring ends and said supporting members being adapted to receive means for permanent affixation of said spring ends to said supporting members, whereby said shoulder members engage the spring ends for application of the permanent affixation of the spring ends and the shoulders away from the point of stress and toward said shoulders.

4. A centering device adapted to be mounted on a running-in string to be disposed in a well bore comprising: upper and lower longitudinally spaced collars, each collar comprising two substantially half sections adapted to be secured together, each section having a plurality of circumferentially spaced openings therein, shoulder members on each of said longitudinally spaced collars circumferentially extending around the uppermost interior of said longitudinally spaced collars, circumferentially spaced outwardly bowed springs, each of said springs having a point of stress and each said spring extending between said collars and overlying the exterior of said sections and extending inwardly through said openings, said springs having portions disposed in said openings, said springs having immediate each end thereof a fulcrum, an inwardly extendible incline defined immediate said fulcrum, each of said spring ends conforming to the curvature of the respective supporting member and adapted to be substantially parallel to the axis of said respective supporting member, said incline defining the point of stress of said bowed springs, said portions including extensions received in said openings, whereby each said spring longitudinally overlaps that portion of said section defining, in part, said opening to interlock said spring extension with said portion of said section, said opening receiving said spring without permitting relative lateral shifting movement of said spring within said opening of said longitudinally spaced collar, said spring ends being welded to said longitudinally spaced collars, the engagement of said spring ends upon said shoulders providing means for applying the weld of the spring ends and the shoulders away from the point of stress and toward said shoulders.

5. A centering device adapted to be mounted on a running-in string to be disposed in a well bore comprising: a collar comprising two substantially half sections adapted to be secured together, each half section including upper and lower sleeve sections, said sleeve sections having a plurality of aligned circumferentially spaced openings therethrough, circumferentially spaced outwardly bowed springs, each of said springs defining a stress point and each of said springs overlying the exterior of said sections and extending inwardly through said openings, said openings being adapted to receive said springs without permitting relative lateral movement of said springs within said sections and said collars, said springs having portions disposed in said openings and engageable with said sleeve section, said springs having immediate each end thereof a fulcrum, an inwardly extendible incline defined immediate said fulcrum, each of said spring ends conforming to the curvature of the respective supporting member and adapted to be substantially parallel to the axis of said respective supporting member, said incline defining the point of stress of said bowed springs, said spring portions including extensions received in said openings, whereby each of said extensions longitudinally overlaps the part of said sleeve section defining, partially, said opening, said sleeve sections each having upper circumferentially and inwardly extending shoulder members for engagement of the respective ends of each of said bowed springs, said springs being permanently secured to said half sections by means of application of welds to each of said half sections and said bowed springs to prevent the removal of said spring portion from said collar and to provide means for applying the weld of the spring ends and the shoulders away from the point of stress and toward said shoulders.

6. A centering device adapted to be mounted on a running-in string to be disposed in a well bore, comprising: first and second companion members having a plurality of circumferentially spaced openings therein, shoulder members on each said first and second companion members circumferentially extending around the uppermost interior of said companion members, outwardly bowed spring elements having a point of stress and each said spring having upper and lower ends overlying the exterior of said companion members and extending inwardly through said openings, said springs having portions disposed in said openings, said springs having immediate each end thereof a fulcrum, an inwardly extendible incline defined immediate said fulcrum, each of said spring ends conforming to the curvature of the respective supporting member and adapted to be substantially parallel to the axis of said respective supporting member, said incline defining the point of stress of said bowed springs, the upper and lower ends of said spring respectively engaging upper and lower shoulders of said companion members, said portions of said springs including extensions received within said openings whereby each of said spring extensions longitudinally overlaps that portion of said companion member defining, in part, said opening to interlock said spring extension with said portion of said companion member to prevent removal of said spring portion from said companion, said opening receiving said spring without permitting the lateral shifting movement of said spring, said spring ends being welded to each of said companion members, the engagement of said springs upon said shoulders providing means for applying the weld of the spring ends and the shoulders away from the point of stress and toward said shoulders.

7. A centering device adapted to be mounted on a running-in string to be disposed in a well bore, comprising: upper and lower companion supporting members having a plurality of circumferentially spaced openings therein, shoulder members on each of said upper and lower supporting members circumferentially extending around the uppermost end of said supporting members, circumferentially spaced outwardly bowed springs having a point of stress and having upper and lower ends overlying the exterior of said supporting members and extending through said openings, said springs having portions disposed in said openings, said springs having immediate each end thereof a fulcrum, an inwardly extendible incline defined immediate said fulcrum, each of said spring ends conforming to the curvature of the respective supporting member and adapted to be substantially parallel to the axis of said respective supporting member, said incline defining the point of stress of said bowed springs, the upper and lower ends of said springs respectively engaging the shoulder members of said support members, said portions of said springs including extensions received within said openings whereby each of said spring extensions longitudinally overlaps said portion of said supporting member defining, in part, said opening to interlock said spring extensions with said portion of said supporting members to prevent removal of said spring portion from said support, said opening receiving said spring without permitting the lateral shifting movement of said spring, said spring ends being welded to said supporting members, the engagement of said springs upon said shoulders providing means for applying the weld of the spring ends and the shoulders away from the point of stress and toward said shoulders.

8. A centering device adapted to be mounted on a running-in string to be disposed in a well bore, comprising: upper and lower companion members having a plurality of circumferentially spaced openings therein, shoulder members on each of said upper and lower companion supporting members circumferentially extending around the uppermost end of said supporting members, circumferentailly spaced outwardly bowed springs having a point of stress and upper and lower ends overlying the exterior of said supporting members and extending through said openings, said springs having portions disposed in said openings, said springs having immediate each end thereof a fulcrum, an inwardly extendible incline defined immediate said fulcrum, each of said spring ends conforming to the respective supporting member and adapted to be substantially parallel to the axis of said respective supporting member, said incline defining the point of stress of said bowed springs, the upper and lower ends of said springs respectively engaging the respective shoulders of said support members, said portions of said springs including extensions received within said openings whereby each of said spring extensions longitudinally overlaps that portion of said supporting member, defining, in part, said opening to interlock said spring extension with said portion of said supporting member to prevent removal of said spring portion from said support, said opening receiving said spring without permitting the lateral shifting movement of said spring, said spring ends being permanently affixed to said supporting members by means of elements insertable through and received within said spring ends and said supporting members, the engagement of said springs upon said shoulders providing means for applying the permanent affixation of the spring ends and the shoulders away from the point of stress and toward said shoulders.

* * * * *